US007040861B2

(12) United States Patent
Clifford et al.

(10) Patent No.: US 7,040,861 B2
(45) Date of Patent: May 9, 2006

(54) METHOD AND APPARATUS FOR REDUCING SELF SEALING FLOW IN COMBINED-CYCLE STEAM TURBINES

(75) Inventors: Samuel Gregory Clifford, Ballston Spa, NY (US); Michael Joseph Boss, Scotia, NY (US); David Forrest Loy, Ballston Lake, NY (US); Norman Douglas Lathrop, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 131 days.

(21) Appl. No.: 10/708,453

(22) Filed: Mar. 4, 2004

(65) Prior Publication Data

US 2005/0196267 A1 Sep. 8, 2005

(51) Int. Cl.
*F01D 11/00* (2006.01)

(52) U.S. Cl. ..... 415/174.2; 415/174.5; 415/231

(58) Field of Classification Search ..... 415/174.2, 415/174.5, 231, 93, 94
See application file for complete search history.

(56) References Cited

U.S. PATENT DOCUMENTS

| | | | | |
|---|---|---|---|---|
| 4,961,310 | A | 10/1990 | Moore et al. | 60/39.182 |
| 5,388,411 | A | 2/1995 | McKeever et al. | 60/646 |
| 6,250,640 | B1 | 6/2001 | Wolfe et al. | 277/355 |
| 2002/0190474 | A1* | 12/2002 | Turnquist | 277/355 |

* cited by examiner

*Primary Examiner*—Edward K. Look
*Assistant Examiner*—Richard A. Edgar
(74) *Attorney, Agent, or Firm*—Cantor Colburn LLP

(57) ABSTRACT

A method and apparatus for reducing self sealing flow in a combined cycle double flow steam turbine, the method and apparatus include providing a brush seal in a packing ring of a packing ring assembly at either end defining the double flow steam turbine.

14 Claims, 3 Drawing Sheets

METHOD AND APPARATUS FOR REDUCING SELF SEALING FLOW IN COMBINED-CYCLE STEAM TURBINES

BACKGROUND OF THE INVENTION

The present invention relates to steam turbines and, more particularly, to a method and apparatus for reducing the amount of steam flow required by the steam seal system in order to properly "self seal" a double flow combined cycle steam turbine.

Currently available combined cycle systems of the assignee of this invention include single and multi-shaft configurations. Single shaft configurations may include one gas turbine, one steam turbine, one generator and one heat recovery steam generator (HRSG). The gas turbine and steam turbine are coupled to the single generator in a tandem arrangement on a single shaft. Multi-shaft systems, on the other hand, may have one or more gas turbine-generators and HRSG's that supply steam through a common steam header to a single steam turbine generator. In either case, steam is generated in one or more HRSG's for delivery to the condensing steam turbine.

It is well known that when a steam turbine is operating at a load below its self-sealing point, steam from an external supply (i.e., make-up steam) must be provided to the seal steam header to maintain the turbine seals until a self-sealing point is reached.

When a steam turbine "self seals", it refers to the ability of the turbine to pressurize (i.e., create a vacuum) and "seal" the ends of the double flow low pressure (LP) rotor. When a turbine fails to self seal, it cannot pressurize and create a vacuum at the ends of the LP rotor using its allocated steam. In this instance, additional "makeup" steam is required to feed the steam seal header. The steam flow requirement for the steam seal system, which is supplied by the high pressure (HP) and intermediate pressure (IP) sections of the turbine, is based on the steam flow demand required by the low pressure (LP) turbine section. Hence, if the LP steam flow demand is lowered, then the supply steam from the HP and IP sections can be reduced.

The "makeup" steam taken from the HP and IP sections to feed the steam seal system bypasses the steam path all together, eliminating all possibilities to extract the energy of the steam through the turbine buckets and nozzles. The wasted opportunity costs of this bypassed steam limits the ability of the turbine to reach entitlement (maximum efficiency).

Furthermore, if a turbine experiences a "rub" event, in which the teeth of the metal packing ring make contact with the rotor and become damaged, the radial clearance, or the distance between the teeth and the rotor, increases. This increase in radial clearance causes the required flow, Q, to self seal to increase. If, in fact, the LP packing rings experience a significant rub, then the required flow, Q, to self seal can increase beyond the capability of the HP and IP turbines to supply enough steam to feed a steam seal header (SSH) to seal the newly rubbed LP packing rings.

Therefore, a solution is needed to reduce the source steam flow requirement coming from the HP and IP turbines to feed the steam seal header (SSH) and reduce self-sealing failure probability due to a rub event.

BRIEF DESCRIPTION OF THE INVENTION

The above discussed and other drawbacks and deficiencies are overcome or alleviated in an exemplary embodiment by a method for reducing self sealing flow in a combined cycle double flow steam turbine. The method includes providing a brush seal in a packing ring of a packing ring assembly at either end defining the double flow steam turbine.

In another exemplary embodiment, an apparatus for reducing self sealing flow in a combined cycle double flow steam turbine is disclosed. The apparatus includes a brush seal disposed in a packing ring of a packing ring assembly at either end defining the double flow steam turbine.

In yet another exemplary embodiment, a method for reducing self sealing flow in a combined cycle double flow steam turbine includes sealing both ends defining the double flow steam turbine with a brush seal in a packing ring of a packing ring assembly at either end defining the double flow steam turbine.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several Figures.

DETAILED DESCRIPTION OF THE INVENTION

Figure 1:
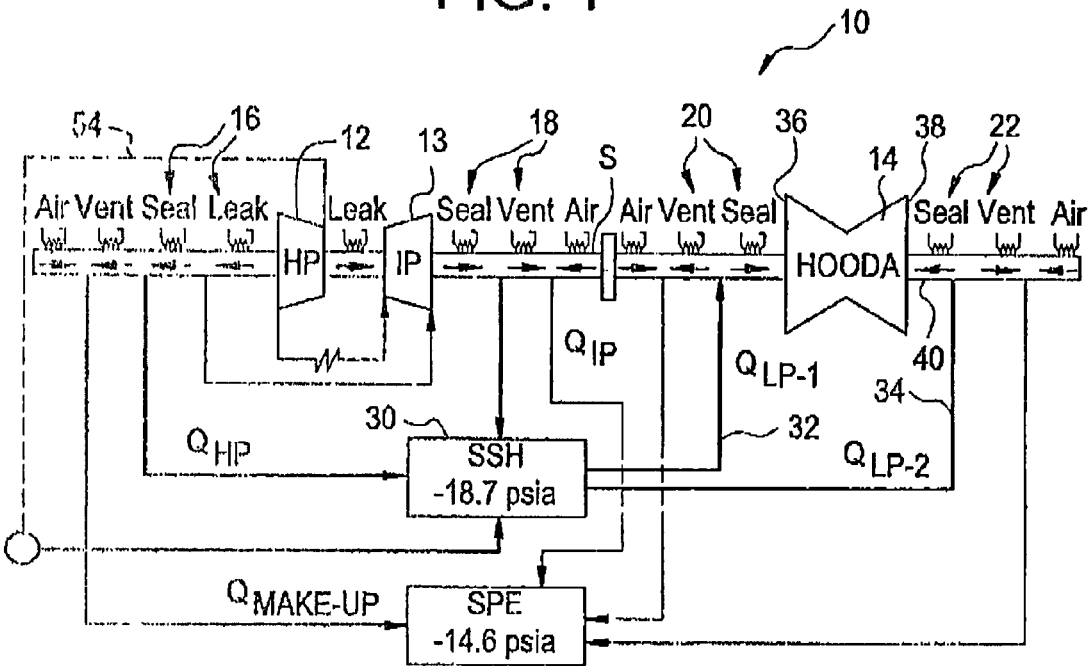
FIG. 1 schematically shows a combine-cycle double-flow turbine and corresponding flow diagram having four brush seals inserted into industry standard packing rings in the "Seal" and "Vent" locations proximate LP rotor ends of a LP turbine section thereof in accordance with an exemplary embodiment.

Referring now to FIG. 1, a steam turbine 10 is shown which includes a high pressure section 12, an intermediate section 13, and a low pressure section 14. Steam turbine 10 also includes associated high pressure seals 16 and intermediate pressure 18, and low pressure seals generally indicated at 20 and 22, surrounding the rotor or shaft S.

Seal steam is supplied to the seals 20 and 22 by means of a seal steam header (SSH) 30 and branch conduits 32, 34.

Valves employed therein (not illustrated in the diagram) are conventional in location and operation and need not be described here. The operation of the system in accordance with an exemplary embodiment will now be described.

FIG. 1 illustrates that the source steam for SSH 30 is from Q HP and Q IP, wherein Source Steam=(Q HP+Q IP). The leakage flow in the steam seal header 30 is used to seal the ends 36 and 38 of the double-flow Low Pressure (LP) turbine section 14. The required sealing steam for the LP turbine section 14 is referred to as the Demand Steam=(Q LP-1+Q LP-2). Therefore, when turbine 14 is able to pressurize (i.e., create a vacuum) and seal the ends 36, 38 disposed about an LP rotor 40 using its allocated sealing steam, then, $$\text{Self-Sealing}=(Q\ HP+Q\ IP)=(Q\ LP\text{-}1+Q\ LP\text{-}2)$$

If the required demand steam is lowered, then the supply or source steam can be lowered as well, increasing the overall turbine performance due to the reduction in leakage steam (supply or source steam).

Figure 2:
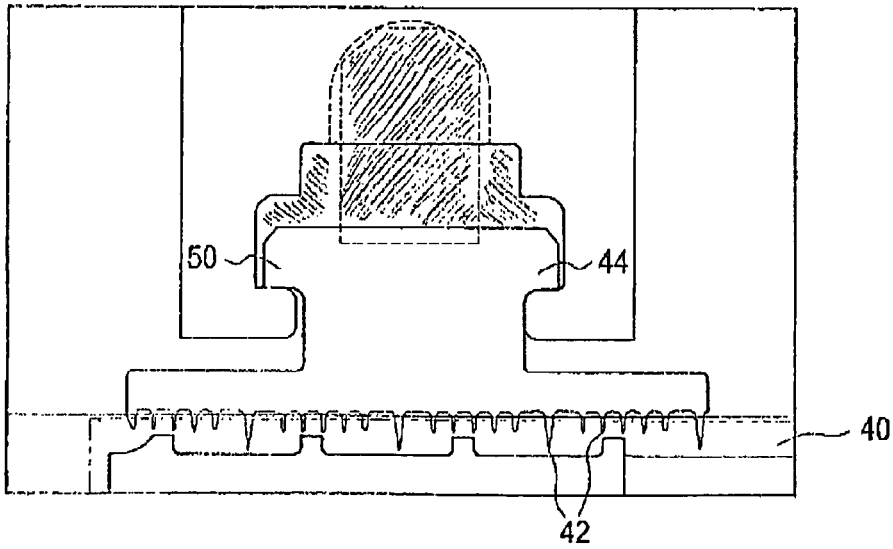
FIG. 2 PRIOR ART
FIG. 2 is a cross-sectional view through a stator and rotor of turbomachinery illustrating a prior art "Hi-Lo" packing ring used to control a Q LP-1 flow of FIG. 1.
Figure 3:
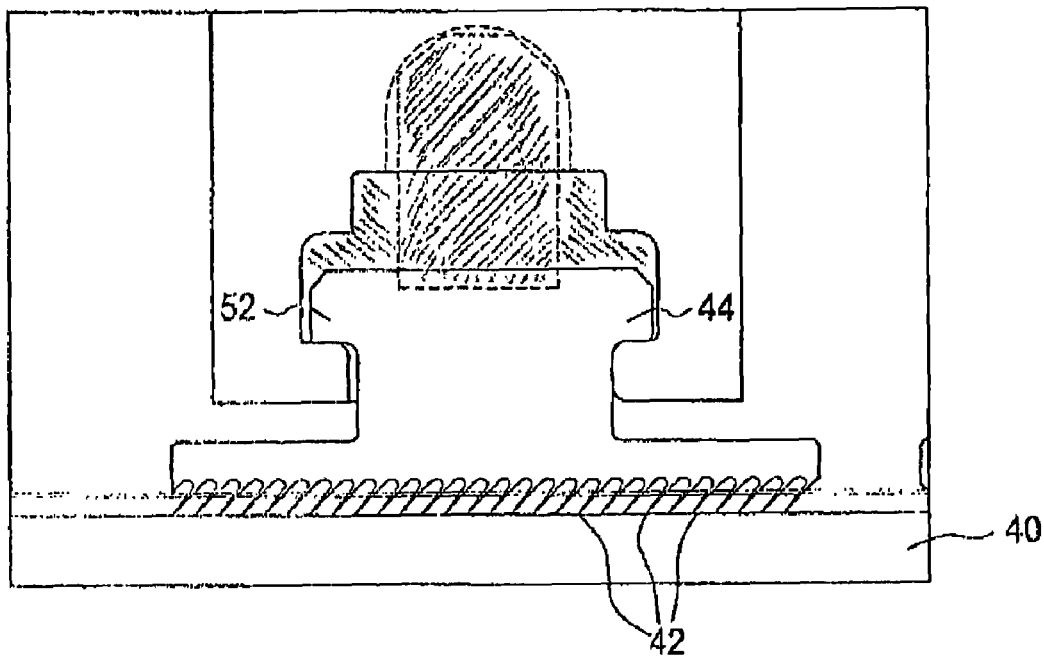
FIG. 3 PRIOR ART
FIG. 3 is a cross-sectional view through a stator and rotor of turbomachinery illustrating a prior art "Slant tooth" packing ring used to control a Q LP-2 flow of FIG. 1.

Referring to FIGS. 2 and 3, the current hardware to control the self-sealing performance of double flow LP turbines 14 is illustrated as industry standard packing rings 44 disposed around LP rotor 40. In particular, FIG. 2 illustrates a typical "Hi-Lo" packing ring 50 used to control the Q LP-1 flow at end 36. FIG. 3 illustrates a typical "Slant Tooth" packing ring 52 used to control the Q LP-2 flow at end 38.

Referring now to FIGS. 1–3, if turbine 14 experiences a "rub" event, in which teeth 42 of metal packing ring 44 make contact with the rotor 40 and become damaged, the radial clearance increases, as discussed above. This increase in radial clearance causes the flow, Q, to increase therethrough. If the LP packing rings 44 experience a significant rub, then the demand steam, (Q LP-1+Q LP-2), can increase beyond the capability of the HP and IP turbines 12 and 13 to supply enough steam to seal the newly rubbed LP packing rings 44. Turbine 14 then fails to self-seal under the following condition:

$$\text{Self-Sealing Failure}=(Q\ LP\text{-}1+Q\ LP\text{-}2)>(Q\ HP+Q\ IP)$$

When turbine 14 fails to self seal, it cannot pressurize and create a vacuum at the ends 36, 38 of the LP rotor 40 using its allocated steam. In this instance, additional "makeup" steam is required to feed the steam seal header 30, therefore:

$$\text{Self-Sealing w/Make-Up}=(Q\ HP+Q\ IP+Q\text{MAKE UP})=(Q\ LP\text{-}1+Q\ LP\text{-}2)$$

Referring again to FIG. 1, QMake-up normally comes from a "throttle" steam. The makeup throttle steam is at inlet conditions, which means it is high pressure, high temperature, and high energy. This inlet steam bypasses the HP turbine section 12 altogether indicated generally with phantom line 54, therefore turbine 12 never gets the opportunity to extract the energy from this steam. Estimated HP turbine efficiency degradation is approximately 0.5% when turbine 14 fails to self seal and requires makeup steam that is taken from the HP turbine section 12.

The current difficulties with the prior art approach involve variation in packing ring manufacturing, turbine installation, and turbine operation. Since the steam flows of the HP, IP and LP turbine sections 12, 13, and 14, respectively, are a strong function of the radial clearances between the LP rotor 40 and the packing teeth 42, there can be a large variation in the self-sealing performance of the steam turbine 14.

The radial clearance variation, and hence the steam flow variation, is a combined result of the manufacturing process capability of the packing ring 44 as well as the installation and alignment process capability of the rotor 40 relative to the packing ring 44. Also, during turbine operation, a rub event can occur in which packing teeth material is literally "rubbed" away by contact between the rotor 40 and packing teeth 42. This rub event causes permanent damage to the packing ring 44 along with a permanent clearance enlargement. These three sources of variation (e.g., manufacturing variation, installation variation, and turbine misoperation) can make it very difficult to maintain an acceptable self-sealing performance level.

Figure 4:
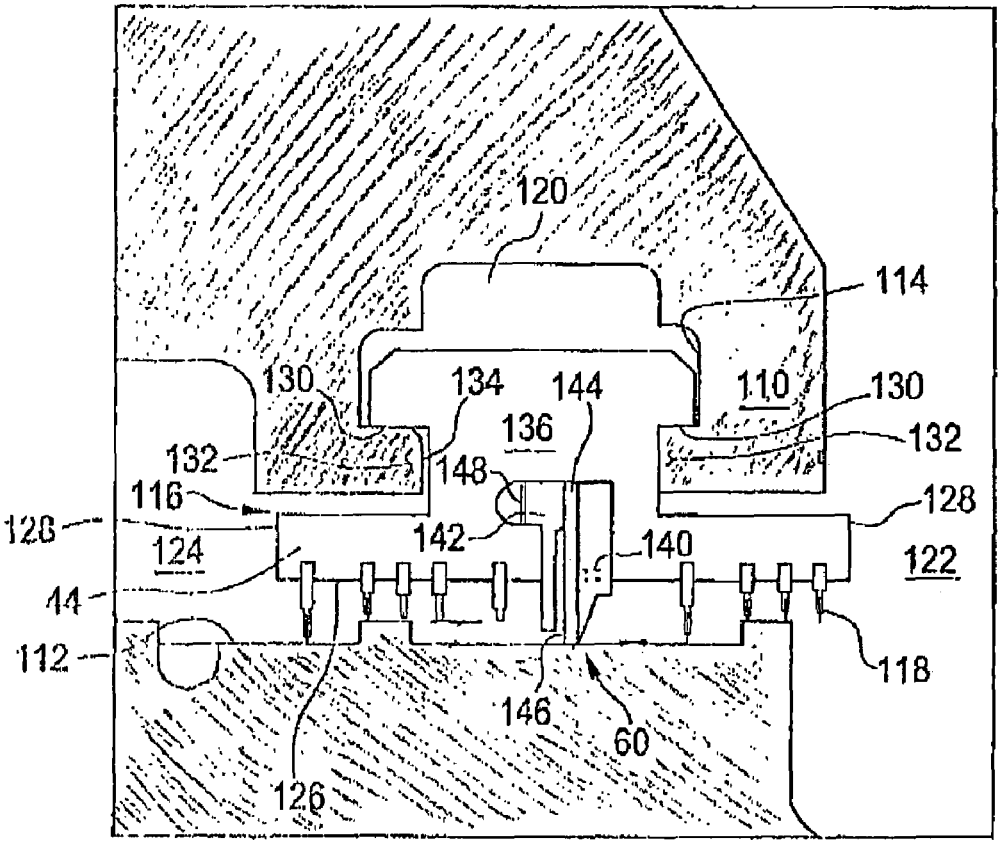
FIG. 4 is a cross-sectional view through a stator and rotor of turbomachinery illustrating an exemplary embodiment of a brush seal with in a packing ring used to control Q LP-1 and/or Q LP-2 flow of FIG. 1

Referring now to FIG. 4 in conjunction with FIG. 1, an implementation of a brush seal 60 with packing ring 44 is illustrated in accordance with an exemplary embodiment. In particular, four brush seals 60 are inserted into corresponding industry standard packing rings in the "Seal" and "Vent" locations proximate LP rotor ends 36, 38 of an LP turbine section 14 thereof in accordance with an exemplary embodiment. The "Seal" and "Vent" locations correspond with the low pressure seals generally indicated at 20 and 22, surrounding rotor 40 in FIG. 1. More particularly, one of the two brush seals is disposed at either end is (disposed in a vent ring of a packing casing and the other is disposed in a seal ring of the packing casing. The implementation of brush seal 60 installed with each packing ring 44 reduces the radial clearance/steam flow variation seen in the LP turbine 14. Bristles 144 of the brush seal 60 are both forgiving and compliant, therefore brush seal 60 can absorb or dampen manufacturing variation, installation variation, and turbine misoperation with substantially less variation in steam flow.

More specifically, FIG. 4 illustrates a stationary component 110 and a rotary component 112 forming part of turbomachinery, both the stationary and rotary components 110 and 112, respectively, lying about a common axis corresponding with shaft or rotor 40 in FIG. 1. The stationary component 110 has a dovetail groove 114 for receiving a packing ring assembly, generally indicated at 116, mounting labyrinth sealing teeth 118 for providing a multi-stage labyrinth seal. In general, the labyrinth seal functions by placing a relatively large number of partial barriers to the flow of steam from a high pressure region 124 on one side of the seal to a low pressure region 122 on the opposite side. Each barrier, i.e., tooth 118, forces steam attempting to flow parallel to the axis of the turbine shaft 112 to follow a tortuous path whereby a pressure drop is created. Thus, each seal segment 120 has a sealing face 126 with the projecting radial teeth 118. The sealing face 126 is formed by a pair of flanges 128 standing axially away from one another, although only one such flange may be necessary in certain applications. The radially outer portions of the seal segments 120 include locating hooks or flanges 130 which similarly extend from the segment 120 in axially opposite directions away from one another. The dovetail groove 114 includes a pair of locating flanges 132 which extend axially toward one another defining a slot 134 therebetween. A neck 136 of each segment 120 interconnects the flanges 130 and 128, the neck 136 extending in the slot 134.

It will be appreciated that the segments 120 may comprise positive pressure variable packing ring segments movable between opened outermost large clearance and closed innermost small clearance positions about the shaft 112. The segments are moved to their outermost positions by springs, not shown, disposed between the flanges 130 and the locating flanges 132 and inwardly by steam pressure. These types of variable clearance packing ring segments are known in the art, e.g., see U.S. Pat. No. 5,503,405 of common assignee.

A brush seal is provided in the packing ring segment to provide a combined labyrinth-brush seal. The brush seal includes a pair of plates 140 and 142 on opposite sides of a brush seal pack containing a plurality of bristles 144. The plate 140 includes an axially extending flange 148 for engaging in an axially opening recess in the slot of the seal segment 120 receiving the brush seal. The bristles 144 are preferably welded to one another at their radially outermost ends and project radially at a cant angle generally inwardly beyond the radial innermost edges of the plates 140 and 142 to terminate in free ends 146.

It will be appreciated that conventional brush seal practices require the free ends 146 of the bristle pack to normally engage the surface of the rotor to effect the sealing action during steady state operation of the turbine. The bristles are considered sufficiently flexible to accommodate the radial excursions of the shaft.

In accordance with an exemplary embodiment and as illustrated in FIGS. 1 and 4, the bristle tips are intentionally designed to engage the rotor shaft under steady state operating conditions of the turbomachinery. That is, the brush seal tips are in contact with the rotor relative to the axis to maintain radial contact between the rotor and brush seal tips throughout the entire range of steady state operation of the turbomachinery whereby the dynamic behavior of the rotor is not affected by contact between the bristles and the rotor. Thus, the dynamic behavior of the rotor is not affected by the use of brush seals.

While there is a decrease in sealing performance caused by the clearance between the bristle tips and the rotor, particularly at a cold start-up, the decrease in sealing performance is mitigated and the clearance is reduced to a certain extent by the bristle blow-down effect at operating pressure drop across the brush seal which causes the brush seals to deflect toward the rotor, decreasing the clearance.

The bristles 144 of the brush seal 60 are both forgiving and compliant, therefore brush seal 60 can absorb or dampen manufacturing variation, installation variation, and turbine misoperation with substantially less variation in steam flow.

Utilizing six sigma tools and an in-house thermal design program of the assignee of the present disclosure, a DOE (Design of Experiments) was performed to calculate the self-sealing benefit of using brush seals. The objective of the DOE was to develop a transfer function that predicts the self-sealing point of a combined cycle steam turbine as a function of the variation in the radial clearances of the packing rings 44 or seals 22 and 22disposed at ends 36 and 38, respectively. The variation of radial clearance in these packing segments determines the steam flow supply and demand within the steam seal header system 30, therefore predicting the self-sealing point of the turbine at a given set of radial clearances. The thermal design program used to develop the transfer function is a GE proprietary code that is used to design steam turbines, hence the accuracy of the transfer function results relative to the thermal design program is presumed accurate.

The transfer function calculated an expected self sealing point of a standard combined cycle steam turbine with normal steel packing rings installed in the same configuration "Seal" and Vent" locations disposed on either end 36, 38 of LP turbine 14 (e.g., baseline design):

$$57.22\%=(Q\ HP+Q\ IP)=(Q\ LP\text{-}\mathbf{1}+Q\ LP\text{-}\mathbf{2}).$$

Whereas the transfer function calculated an expected self-sealing point of a standard combined cycle steam turbine with four brush seals 60 installed in the same configuration "Seal" and Vent" locations disposed on either end 36, 38 of LP turbine 14 as:

$$22.56\%=(Q\ HP+Q\ IP)=(Q\ LP\text{-}\mathbf{1}+Q\ LP\text{-}\mathbf{2}).$$

Although four brush seals have been described as being installed into combined-cycle double flow steam turbines, it is contemplated that two can be installed obtaining similar results.

It is further contemplated that the brush seals in accordance with an exemplary embodiment described above can be installed into the rotor ends of every applicable combined cycle steam turbine during upcoming scheduled maintenance outages. The brush seals are easily fitted into already existing turbines in operation.

The brush seals can also be installed in applicable steam turbines currently in work in progress (WIP). New brush seals can be retrofitted into steam turbines currently being manufactured at GE Power Systems, Schenectady, N.Y.

Lastly, brush seals can be inserted into new engineering steam turbine designs that have not yet begun production.

The installation of brush seals at the ends of the double-flow LP rotors reduces the LP demand steam required for self-sealing, (i.e., Q LP-1+Q LP-2). The technical advantages provided include a compliant material used in the brush seals as well as the increased sealing efficiency gained by implementation of the brushes. The brushes are composed of thousands of metal bristles that ride against the rotor to create a seal with an effective radial clearance of about 1/10th of that of a metal packing ring. More specifically, the effective radial clearance between the packing ring assembly and the rotor when using a metal packing ring is between about 20 to about 60 mils, whereas the effective clearance is between about 0 to about 5 mils when using a brush seal with the packing ring assembly. It will be recognized that 1 mil is equivalent to 1/1000 of an inch. It will be recognized by one skilled in the pertinent art that the number of bristles is dependant on a diameter of the rotor. Since these bristles are flexible and compliant, the manufacturing variation, installation variation, and turbine misoperation can be absorbed or dampened relative to the prior art metal packing rings. Prior art packing rings are extremely sensitive to the three sources of variation afore mentioned and are a great source of steam flow variation.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An apparatus for reducing self-sealing flow in a combined cycle double flow steam turbine, the apparatus comprising:

a turbine housing;

a rotor rotatably disposed within said turbine housing;

a first brush seal for reducing clearance between a packing ring and a rotor at a first location, the first location being on a first end of a low-pressure turbine;

a second brush seal for reducing clearance between the packing ring and the rotor at a second location, the second location being adjacent to the first location;

a third bush seal for reducing clearance between the packing ring and the rotor at a third location, the third location being on a second end of low-pressure turbine; and a fourth brush seal for reducing clearance between the packing ring and the rotor at a fourth location, the fourth location being adjacent to the third location;

whereby overall efficiency of the steam turbine is improved by the combined action of the four specifically positioned seals, thereby reducing higher pressure steam source requirements for self sealing of the steam turbine.

2. The apparatus of claim 1, wherein each of the first, second, third, and fourth brush seals has a plurality of bristles and each is configured to be flexible and compliant to limit steam flow variation within the steam turbine.

3. The apparatus of claim 2, wherein the plurality of bristles of each of the first, second, third, and fourth brush seals are metal bristles.

4. The apparatus of claim 2, Wherein the plurality of bristles of each of the first, second, third, and fourth brush seals are welded to one another at their radially outermost ends and project radially at a cant angle.

5. The apparatus of claim 1, wherein the each of the first, second, third, and fourth brush seals are in contact with the rotor in a steady state operation range of the steam turbine.

6. The apparatus of claim 1, wherein each of the first, second, third, and fourth brush seals is configured to create a seal with an effective radial clearance of 0 and 5 mils between the packing ring and the rotor.

7. The apparatus of claim 1, wherein low-pressure steam within the steam turbine is given by [(Q LP-1)+(Q LP-2)], where Q is the required flow and LP is the low pressure.

8. A method for reducing self sealing flow in a combined cycle double flow steam turbine, the method comprising:

reducing clearance between a packing ring and a rotor at a first location, the first location being on a first end of a low-pressure turbine, by disposing a first brush seal at said first location;

reducing clearance between the packing ring and rotor at a second location, the second location being adjacent to the first location, by disposing a second brush seal at said second location;

reducing clearance between the packing ring and the rotor at a third location, the third location being on a second end of low-pressure turbine, by disposing a third brush seal at said third location; and reducing clearance between the packing ring and the rotor at a fourth location, the fourth location being adjacent to the third location, by disposing a fourth brush seal at said fourth location;

whereby overall efficiency of the steam turbine is improved by the combined action of the four specifically positioned seals, thereby reducing higher pressure steam source requirements for self sealing of the steam turbine.

9. The method of claim 8, wherein each of the first, second, third, and fourth brush seals has a plurality of bristles and each is configured to be flexible and compliant to limit steam flow variation within the steam turbine.

10. The method of claim 9, wherein the plurality of bristles of each of the first, second, third, and fourth brush seals are metal bristles.

11. The method of claim 9, wherein the plurality of bristles of each of the first, second, third, and fourth brush seals are welded to one another at their radially outermost ends and project radially at a cant angle.

12. The method of claim 8, wherein the each of the first, second, third, and fourth brush seals are in contact with the rotor in a steady state operation range of the steam turbine.

13. The method of claim 8, wherein each of the first, second, third, and fourth brush seals is configured to create a seal with an effective radial clearance of 0 and 5 mils between the packing ring and the rotor.

14. The method of claim 8, wherein low-pressure steam within the steam turbine is given by [(Q LP-1)+(Q LP-2)], where Q is the required flow and LP is the low pressure.

* * * * *